US007068024B1

(12) United States Patent
Huang

(10) Patent No.: US 7,068,024 B1
(45) Date of Patent: Jun. 27, 2006

(54) VOLTAGE REGULATOR HAVING POSITIVE TEMPERATURE COEFFICIENT FOR SELF-COMPENSATION AND RELATED METHOD OF REGULATING VOLTAGE

(75) Inventor: Chien-Hua Huang, Hsinchu (TW)

(73) Assignee: Taiwan Semiconductor Manufacturing Company, Ltd., Hsinchu (TW)

( * ) Notice: Subject to any disclaimer, the term of this patent is extended or adjusted under 35 U.S.C. 154(b) by 0 days.

(21) Appl. No.: 10/905,386

(22) Filed: Dec. 30, 2004

(51) Int. Cl.
*G05F 3/16* (2006.01)
*G05F 1/10* (2006.01)

(52) U.S. Cl. ..... 323/315; 327/538; 323/907

(58) Field of Classification Search ..... 323/314, 323/315, 316; 327/538, 539
See application file for complete search history.

(56) References Cited

U.S. PATENT DOCUMENTS 4,825,099 A * 4/1989 Barton ..... 326/86
6,075,740 A 6/2000 Leung
6,498,737 B1 12/2002 Kuo

* cited by examiner

*Primary Examiner*—Shawn Riley
(74) *Attorney, Agent, or Firm*—Baker & McKenzie LLP

(57) ABSTRACT

Disclosed herein is a voltage regulator, and related method, for regulating a boost voltage generated by a boost circuit. In one embodiment, the voltage regulator includes a regulated voltage input operable to receive a regulated voltage derived from the boost voltage, a reference voltage input operable to receive a constant reference voltage, and an output node operable to provide a feedback signal to the boost circuit for controlling the generated boost voltage. In addition, the voltage regulator includes at least one transistor coupled to the regulated voltage input, the reference voltage input, and the output node, and operable to produce the feedback signal based on a comparison of the regulated voltage to the reference voltage. The voltage regulator still further includes a variable current source coupled to the output node and having one or more performance characteristics, where the variable current source is operable to generate a variable current at the output node to mitigate the affect of one or more performance characteristics of the at least one transistor based on the comparison and the feedback signal such that the boost circuit generates the boost voltage to be substantially constant.

38 Claims, 6 Drawing Sheets

VOLTAGE REGULATOR HAVING POSITIVE TEMPERATURE COEFFICIENT FOR SELF-COMPENSATION AND RELATED METHOD OF REGULATING VOLTAGE

TECHNICAL FIELD

Disclosed embodiments herein relate generally to the regulation of voltage in electrical circuits, and more particularly to a voltage regulator capable of generating a positive temperature coefficient for self-compensation, as well as related methods of regulating voltage.

BACKGROUND

In recent years, there continues to be dramatic density increases in integrated circuit technology for semiconductor chips. For example, the minimum feature size of lithography, such as the size of MOSFETs, has been reduced to one micrometer and below. In the fabrication of precision capacitors in conjunction with FET devices on the same chip at these reduced dimensions, it is increasingly difficult to maintain manufacturing parameters such that precise outputs from these devices are still available.

Many applications implemented on modern semiconductor chips require accurate voltages. A classic example is writeable memory, which requires the amplitude of the erase voltage to balance the write voltage of the writeable memory cells. If the erase voltage does not accurately match the write voltage, the memory cell will typically continue to store a binary "1" value, rather than the intended "0" binary value. To insure that the write voltage and erase voltage are generated properly, an on-chip voltage regulation circuit (e.g., a voltage regulator) is typically required.

Unfortunately, there are several on-chip and environmental effects that consistently counteract the regulation of on-chip voltages. Examples of these include temperature effects and manufacturing process variations. Relatively extreme variations in temperature, for example, the operating temperature of active devices within a voltage regulator, often affect the resistance, capacitance, voltage and current flow of on-chip components, and thus the overall semiconductor chip itself. In addition, process variations typically affect line spacings and the thickness of oxides, metals, and other layers of the semiconductor wafer, which consequently can affect on-chip voltages. This disclosure is directed to combating the problems caused by temperature fluctuations and process variations in voltage regulator circuitry.

BRIEF SUMMARY

Disclosed herein is a voltage regulator for regulating a boost voltage generated by a boost circuit to compensate an applied voltage of an electrical circuit. In one embodiment, the voltage regulator includes a regulated voltage input operable to receive a regulated voltage derived from the boost voltage, a reference voltage input operable to receive a constant reference voltage, and a control voltage output operable to provide a feedback output voltage to the boost circuit for controlling the generated boost voltage. In addition, the voltage regulator includes at least one active load element coupled to the regulated voltage input, the reference voltage input, and the control voltage output, and operable to produce the feedback output voltage based on a comparison of the regulated voltage to the reference voltage. In such an embodiment, the at least one active load element has one or more performance characteristics affecting the comparison and thus the feedback output voltage. The voltage regulator still further includes a variable current source coupled to the control voltage output and having one or more performance characteristics, where the variable current source is operable to generate a variable current at the control voltage output to mitigate the affect of the one or more performance characteristics of the at least one active load element on the comparison and the feedback output voltage such that the boost circuit generates the boost voltage to be substantially constant.

Also disclosed is a method of regulating a boost voltage generated by a boost circuit. In one embodiment, the method includes receiving a regulated voltage derived from the boost voltage and receiving a constant reference voltage. The method also includes producing a feedback output voltage based on a comparison of the regulated voltage to the reference voltage, where the producing is affected by one or more performance characteristics. Also the method includes providing the feedback output voltage to the boost circuit for controlling the generated boost voltage. Furthermore, in this embodiment, the method also includes generating a variable current associated with the feedback output voltage to mitigate the affect of the one or more performance characteristics on the comparison and the feedback output voltage such that the boost voltage is generated to be substantially constant, where the variable current is also affected by one or more performance characteristics.

BRIEF DESCRIPTION OF THE DRAWINGS

For a more complete understanding of the principles disclosure herein, and the advantages thereof, reference is now made to the following descriptions taken in conjunction with the accompanying drawings, in which.

(1)

(2)

(3)

(4)

(5)

(6)

(7)

DETAILED DESCRIPTION OF PREFERRED EMBODIMENTS

Figure 1:
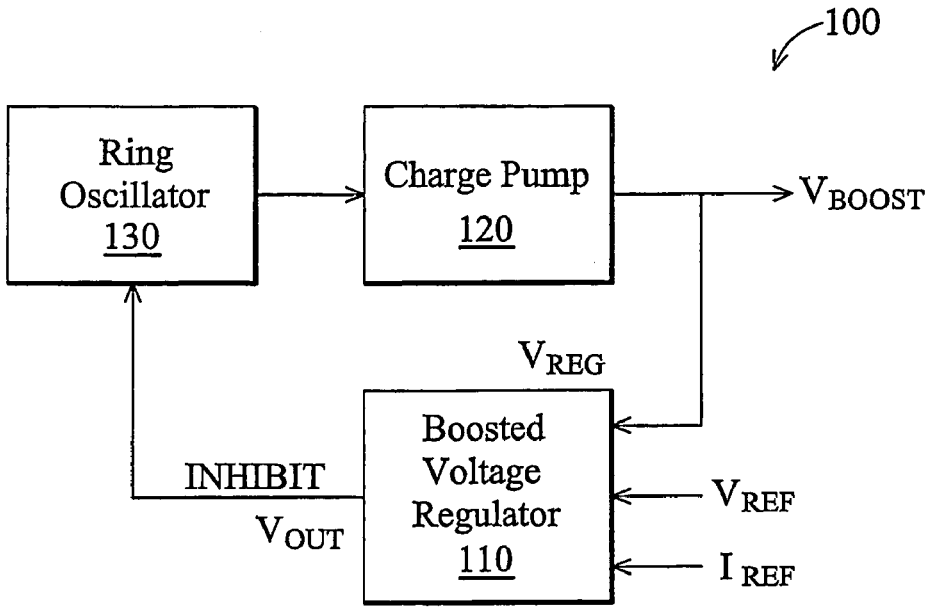
FIG. 1 (PRIOR ART)
FIG. 1 illustrates a general block diagram of one embodiment of a conventional boosted voltage regulator.

Referring initially to FIG. 1, illustrated is a general block diagram 100 of a typical environment of a conventional boosted voltage regulator 110. As illustrated, such boosted voltage regulators 110 typically receive a regulated voltage ($V_{REG}$) as part of a feedback loop, and that regulated voltage $V_{REG}$ is compared to a reference voltage ($V_{REF}$). An output of the boosted voltage regulator 110 ($V_{OUT}$) is then used to control a charge pump 120, typically via a ring oscillator 130, in order to generate the required boosted voltage ($V_{BOOST}$) for use by the desired application. While voltage regulator 110 illustrated in FIG. 1 is discussed as a conventional regulator, the block diagram 100 may also provide an environment for a novel boosted voltage regulator constructed as set forth below.

Conventional boosted voltage regulator circuits 110 are widely utilized in many applications requiring a positive boosted voltage $V_{BOOST}$ higher than the applied voltage of the overall circuit in the application. Alternatively, a negative boosted voltage below ground is provided, as the application varies. For example, when the boosted voltage $V_{BOOST}$ reaches or goes over the regulated level, the regulator 110 will shut down the charge pump 120 so that the positive boosted voltage $V_{BOOST}$ stops increasing. Conversely, when the boosted voltage $V_{BOOST}$ is below the regulated level, the regulator 110 will allow the charge pump 120 to supply the necessary amount of boosted voltage $V_{BOOST}$.

Figure 2:
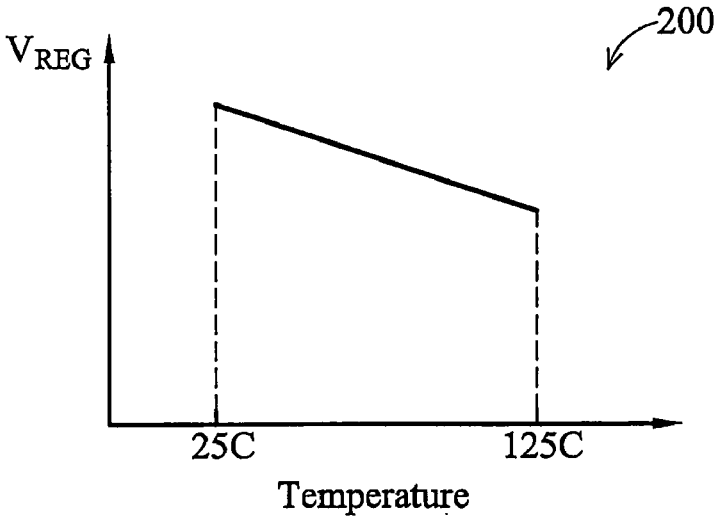
FIG. 2 (PRIOR ART)
FIG. 2 illustrates a graph of the change in regulator voltage generated by the boosted voltage regulator of FIG. 1, plotted as a function of temperature increase during operation.

Unfortunately, the boosted voltage $V_{BOOST}$ regulated by a conventional boosted voltage regulator will typically decrease as operating temperature for the circuit increases. To illustrate this point, attention is turned to FIG. 2 where illustrated is a graph 200 of the change in regulator voltage ($V_{REG}$) used by the conventional boosted voltage regulator 110 shown in FIG. 1, plotted as a function of temperature increase during operation. In this embodiment, the regulator voltage $V_{REG}$ used by the voltage regulator 110 decreases as the operating temperature of the regulator 110 increases from 25° C. to 125° C. Discussed in greater detail below is the effect of the increased temperature on the voltage driven active devices found in the regulator 110.

Figure 3A:
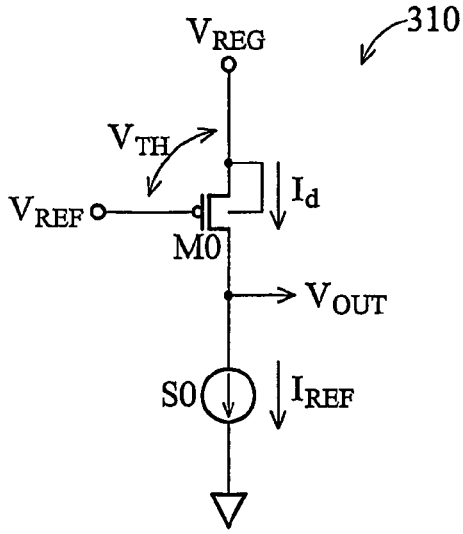
FIG. 3A (PRIOR ART)
FIGS. 3A and 3B illustrate circuit diagrams of conventional positive boosted voltage regulators.
Figure 3B:
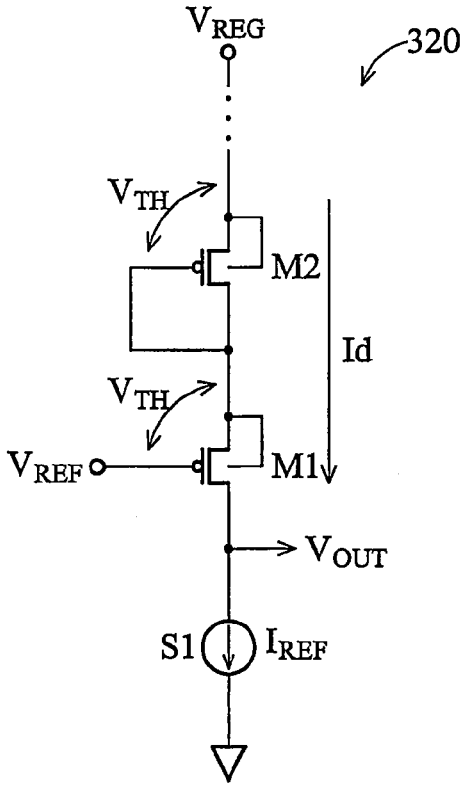
FIG. 3B (PRIOR ART)

Looking now at FIGS. 3A and 3B, illustrated are circuit diagrams of conventional positive boosted voltage regulators 310, 320. Looking individually at the circuits, FIG. 3A illustrates a positive boosted voltage regulator 310 incorporating a single voltage driven active device in the form of transistor device M0. Specifically, the device M0 is a PMOS transistor device having the regulated voltage $V_{REG}$ coupled to its source terminal and a reference voltage $V_{REF}$ coupled to its gate. In addition, a constant reference current ($I_{REF}$) source S0 is provided in the circuit 310, which is coupled to the drain of transistor M0. With regard to FIG. 3B, boosted voltage regulator 320 includes two transistor devices M1, M2, where both are PMOS devices. In this circuit 320, the regulated voltage $V_{REG}$ is coupled to the source of the second transistor M2, while its gate and drain terminals are both coupled to the source of the first transistor M1. The reference voltage $V_{REF}$ is coupled to the gate of the first transistor M1, and a constant reference current $I_{REF}$ source S1 is coupled to its drain terminal.

For either voltage regulator 310, 320, the voltage across the source and gate nodes ($|V_{GS}|$) of the transistors M0, M1, M2 is:

$$V_{GS}=V_{REG}-V_{REF}, \tag{1}$$

and a current through the transistors M0, M1, M2 (Id) is provided. Therefore, during normal operation, the current source S0, S1 draws a constant current $I_{REF}$ through the transistors M0, M1, M2 such that the absolute value of the voltage across the source and gate nodes ($|V_{GS}|$) of the transistors M0, M1, M2 is equal to the absolute value of the respective threshold voltage ($|V_{TH}|$) for those transistors M0, M1, M2. Thus, in the first voltage regulator circuit 310, when:

$$|V_{REG}-V_{REF}|>|V_{TH}|_{(M0)}, \tag{2}$$

the drain current (Id) of M0 will overcome the reference current $I_{REF}$ causing the output $V_{OUT}$ of the voltage regulator 310 to move from low to high. Similarly, in the second voltage regulator circuit 320, when:

$$|V_{REG}-V_{REF}|>|V_{TH}|_{(M1)}+|V_{TH}|_{(M2)}, \tag{3}$$

the drain current (Id) of the transistors M1, M2 will overcome the reference current $I_{REF}$ causing the output $V_{OUT}$ of the voltage regulator 320 to move from low to high. For both circuits 310, 320, when the output $V_{OUT}$ goes high, the charge pump (see FIG. 1) will be inhibited from generating the boost voltage $V_{BOOST}$, thus decreasing the regulator voltage $V_{REG}$ tapped from the $V_{BOOST}$. Once the regulator voltage $V_{REG}$ drops below a certain level, the drain current Id will also drop until it equals the constant reference current $I_{REF}$, where the output $V_{OUT}$ will then go low again.

Therefore, the transfer point for the voltage regulator output $V_{OUT}$ of circuit 310 is defined in equation (4):

$$V_{REG}=V_{REF}+|V_{TH}|, \tag{4}$$

where $V_{REF}$ is the reference voltage and $V_{TH}$ is the threshold voltage of the transistor devices having a negative temperature coefficient. Consequently, the negative temperature coefficient of the transistors M0, M1, M2 results in the regulator voltage $V_{REG}$ decreasing, and thus an incorrect output voltage $V_{OUT}$, as their temperature increases due to a drop in each transistor's threshold voltage $V_{TH}$ (see FIG. 4). The transfer point for the voltage regulator output $V_{OUT}$ of circuit 320 is defined in equation (5):

$$V_{REG}=V_{REF}+N*|V_{TH}|, \tag{5}$$

where $V_{REF}$ and $V_{TH}$ are as defined above for equation (1), and N is the number of PMOS devices in the voltage regulator circuit 320 in series between the output voltage node $V_{OUT}$ and the regulator voltage $V_{REG}$.

Figure 4:
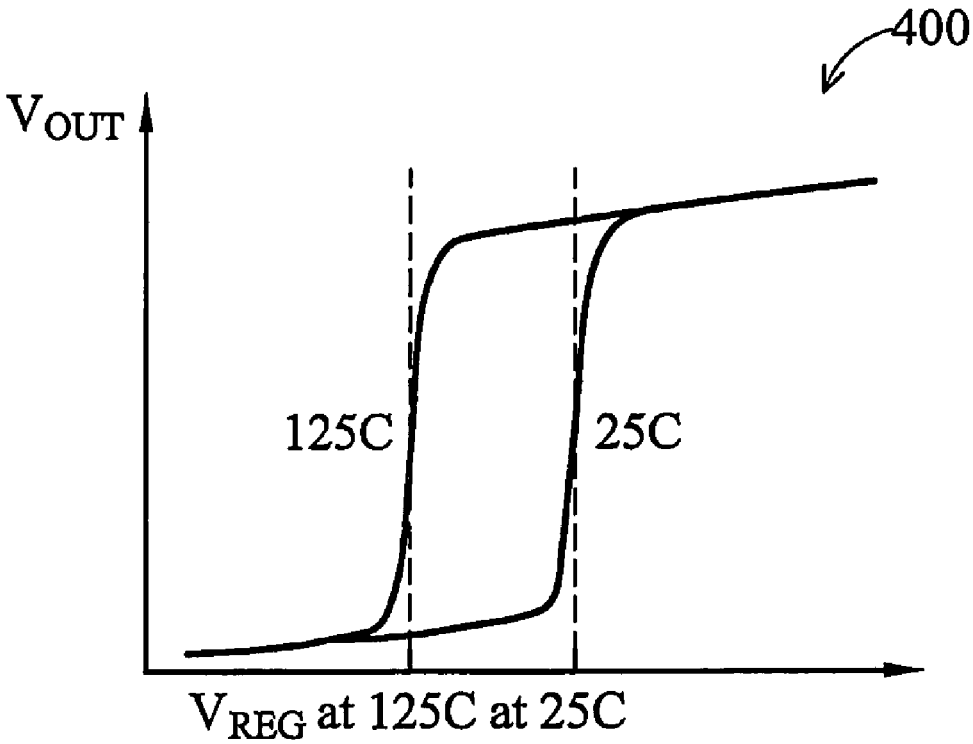
FIG. 4 (PRIOR ART)
FIG. 4 illustrates a graph of a transfer curve for the conventional boosted voltage regulator circuits illustrated in FIGS. 3A and 3B.

Looking briefly at FIG. 4, illustrated is a graph 400 of a transfer curve for the conventional boosted voltage regulator circuits 310, 320 illustrated in FIGS. 3A and 3B. As may be seen, as the operating temperature increases from 25° C. to 125° C., the output voltage $V_{OUT}$ of the voltage regulators 310, 320 goes high at a lower regulated voltage $V_{REG}$, since, as mentioned above, the regulated voltage $V_{REG}$ decreases as temperature increases due to the drop in threshold voltage $V_{TH}$. Stated another way, the drain current Id will increase at the same regulator voltage $V_{REG}$ as the temperature increases because of the drop in threshold voltage $V_{TH}$. As a result, the accuracy of the compensation provided by the voltage regulators 310, 320 diminishes with an increase in operating temperature. The graph 400 accordingly illustrates the problem of a negative temperature coefficient addressed by a circuit designed and operated as disclosed herein.

Figure 5:
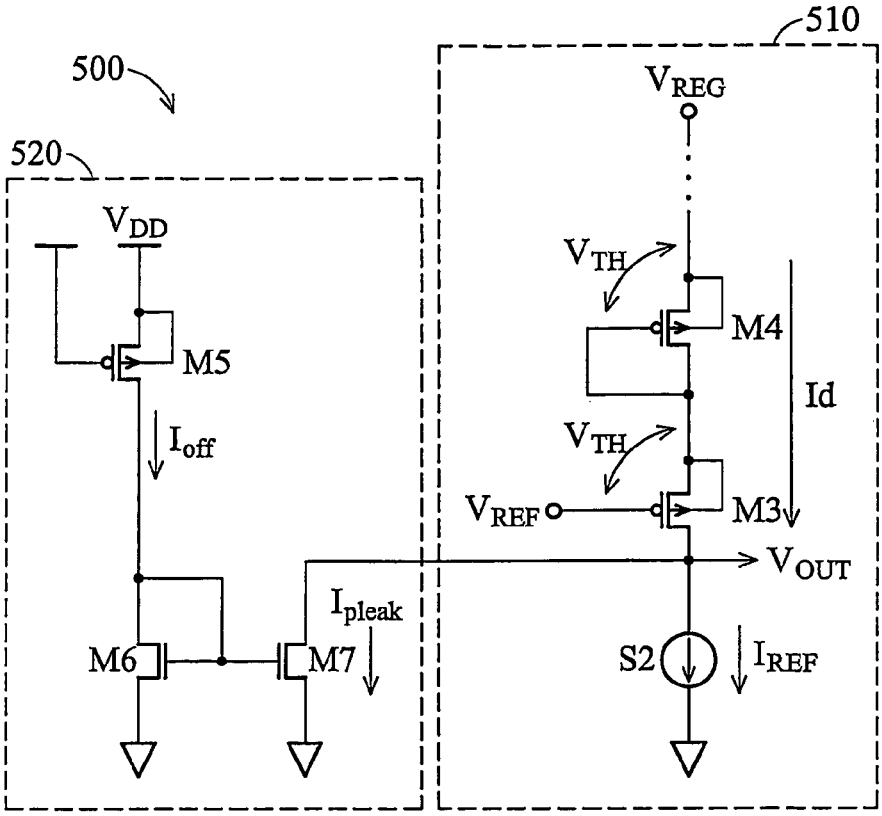
FIG. 5 illustrates a circuit diagram of one embodiment of a positive boosted voltage regulator constructed according to the principles disclosed herein.

Turning now to FIG. 5, illustrated is a circuit diagram of one embodiment of a positive boosted voltage regulator 500 constructed according to the principles disclosed herein. Similar to the second conventional voltage regulator circuit 320 illustrated in FIG. 3B, the disclosed voltage regulator 500 includes first and second transistor devices M3, M4, which are PMOS devices. The regulated voltage $V_{REG}$ input to the voltage regulator 500 is coupled to the source of the second transistor M4, while its gate and drain terminals are both coupled to the source of the first transistor M3. Also, a constant reference voltage $V_{REF}$ is coupled to the gate of the first transistor M3, while a constant reference current ($I_{REF}$) source S2 is coupled to the drain of transistor M3. Also as before, the output voltage $V_{OUT}$ of the voltage regulator 500 is found between the drain of the first transistor M3 and the constant current source S2. These components of the voltage regulator 500 form a base circuit 510.

The voltage regulator 500 of FIG. 5 also includes third, fourth and fifth transistor devices M5, M6, M7. The third transistor M5 is a PMOS device, while the fourth and fifth transistors M6, M7 are NMOS devices, for a positive boost circuit. Specifically, the source and gate of the third transistor M5 are coupled to a power supply voltage ($V_{DD}$), while the drain of the third transistor M5 is coupled to the source of the fourth transistor M6. While the drain of the fourth transistor M6 is coupled to ground, its gate is coupled to the gate of the fifth transistor M7. Finally, the source of the fifth transistor M7 is coupled to the node where the output voltage $V_{OUT}$ from the voltage regulator 500 is tapped (i.e., between the drain of the first transistor M3 and the constant current source S2), while the drain of the fifth transistor M7 is coupled to ground. With these connections in mind, a discussion of the operation of the voltage regulator 500 follows.

As mentioned above, during the boosting of voltage at the output $V_{OUT}$ of the voltage regulator 500, the threshold voltage $V_{TH}$ of the transistors M3, M4 in the base circuit 510 decreases as temperature increases. This results in the threshold voltage $V_{TH}$ being overcome at a lower regulator voltage $V_{REG}$, which causes the drain current Id to increase too soon and make the output voltage $V_{OUT}$ prematurely high. Accordingly, the disclosed voltage regulator 500 is configured to overcome the problems associated with threshold voltage $V_{TH}$ decline at high temperatures, by incorporating this characteristic of MOSFET threshold voltage $V_{TH}$ into a leakage current source 520 that provides a positive temperature coefficient to the base circuit 510.

As illustrated in FIG. 5, to create a positive temperature coefficient for the voltage regulator 500, the variable leakage current source 520 is created with the coupling of the third, fourth and fifth transistor devices M5, M6, M7 in the manner described above. More specifically, this leakage current source 520 creates a variable leakage current ($I_{p\text{-}leak}$) at the drain of the original first transistor device M3 (at the same place as the output voltage $V_{OUT}$). As a result, equation (5) (or even equation (4), if only one transistor device is used to create the output voltage $V_{OUT}$) may be modified to derive equation (6):

$$V_{REG}=V_{REF}+N*|V_{TH}|+\Delta V(I_{p\text{-}leak}). \tag{6}$$

As before, $V_{REF}$ and $V_{TH}$ are as defined above, N is the number of PMOS devices that are placed in series between the output voltage node $V_{OUT}$ and the regulator voltage $V_{REG}$, and $V(I_{p\text{-}leak})$ is a positive temperature coefficient item created by the leakage current $I_{p\text{-}leak}$ drawn by the leakage current source 520. The $\Delta V(I_{p\text{-}leak})$ is the cumulative threshold voltage $V_{TH}$ difference across the N transistors based on their drain/source currents $I_{DS}$ when the leakage current $I_{p\text{-}leak}$ is drawn.

During operation, the PMOS M5 is biased at an OFF state because the gate is coupled to the power supply $V_{DD}$; thus, the gate-source voltage $V_{GS}$ of PMOS M5 is 0 Volts. As a result, the current $I_{off}$ drawn from PMOS M5 is an off current or a sub-threshold current or a sub-threshold leakage. However, the current $I_{off}$ from PMOS M5 rapidly increases as its temperature rises during operation. This current $I_{off}$ then drains through NMOS M6. Transistors M6 and M7 are coupled together to form a current mirror. Therefore, as the current drained from PMOS M5 through NMOS M6 is magnified, the magnification is mirrored through NMOS M7 to draw a current $I_{p\text{-}leak}$. The ratio of magnification corresponds to the ratio of transistor size for NMOS M7 over NMOS M6.

Figure 6:
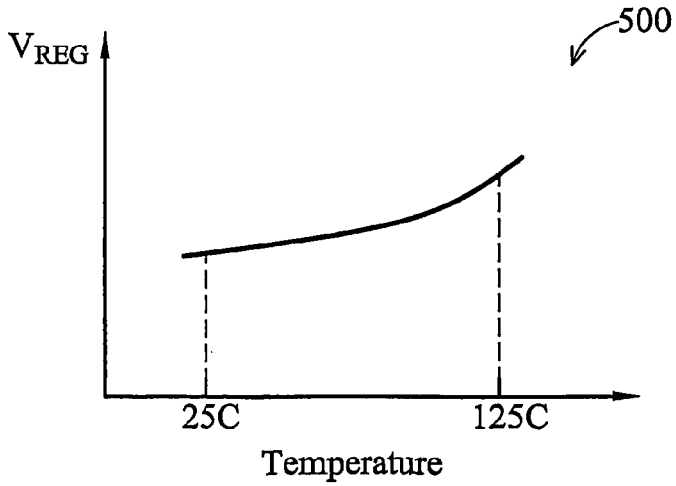
FIG. 6 illustrates a graph of the increase in regulated voltage, as a function of temperature increase, provided by the leakage current source of the disclosed boosted voltage regulator.

As illustrated, the leakage current $I_{p\text{-}leak}$ is pulled from the drain of the first transistor M3, where the output voltage $V_{OUT}$ is tapped. As mentioned above, when the current through PMOS M3 overcomes the reference current $I_{REF}$ (which remains constant), the output voltage $V_{OUT}$ increases. Since the increasing temperature typically results in the drain current Id overcoming the reference $I_{REF}$ current sooner than desired, because the decreased threshold voltage $V_{TH}$ is overcome by a lower regulator voltage $V_{REG}$, the leakage current $I_{p\text{-}leak}$ compensates for the premature drain current Id so that the output voltage $V_{OUT}$ does not increase as quickly. Since the amount of leakage current $I_{p\text{-}leak}$ is proportional to the temperature increase (through PMOS M5), when the drain current Id increases based on the threshold voltage $V_{TH}$ degradation caused by increasing temperature, the leakage current $I_{p\text{-}leak}$ proportionally increases based on that same increasing temperature. By proportionally compensating for this threshold voltage $V_{TH}$ decline, the output voltage $V_{OUT}$ is not allowed to go high until a higher regulator voltage $V_{REG}$ is reached. As a result, the regulator voltage $V_{REG}$ is allowed to reach substantially the same amount that would be required make the output $V_{OUT}$ high if increasing temperature did not decrease the threshold voltage $V_{TH}$ of NMOS M3 and M4 in the first place (i.e., before increased temperature degraded the threshold voltage $V_{TH}$). Looking briefly at FIG. 6, illustrated is a graph 600 of the increase in regulated voltage $V_{REG}$, as a function of temperature increase, provided by the leakage current source 520 of the disclosed boosted voltage regulator.

In addition, with a voltage regulator circuit constructed according to the disclosed principles, the voltage expense of generating the leakage current $I_{p\text{-}leak}$ by operating the leakage current source 520 as disclosed above is relatively low, especially in low temperature situations. A still further benefit of the disclosed voltage regulator circuit is that the same or similar compensation may be provided if the threshold voltage $V_{TH}$ decline is caused by process variation when manufacturing the circuit. In this situation, as before, PMOS M5 will have a current $I_{off}$ leaking therethrough because of the same threshold voltage $V_{TH}$ decline based on a process corner variation in all the MOSFETs in the regulator circuit. As a result, the leakage current $I_{p\text{-}leak}$ generated by the leakage current source disclosed herein will equally compensate the decline in threshold voltage $V_{TH}$ found in the base circuit MOSFETs in spite of manufacturing process variations.

Figure 7A:
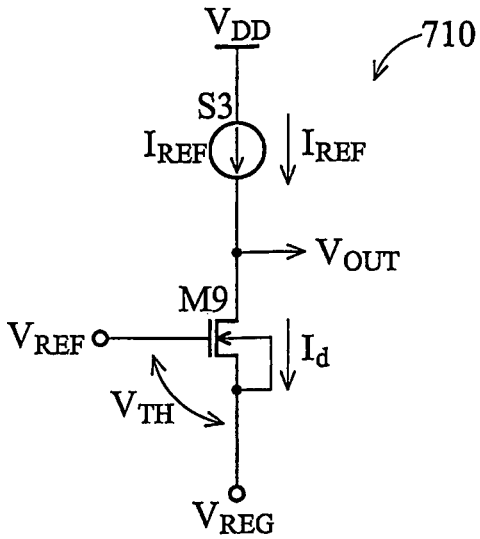
FIG. 7A (PRIOR ART)
FIGS. 7A and 7B illustrate circuit diagrams of conventional negative boosted voltage regulators; and (8)
Figure 7B:
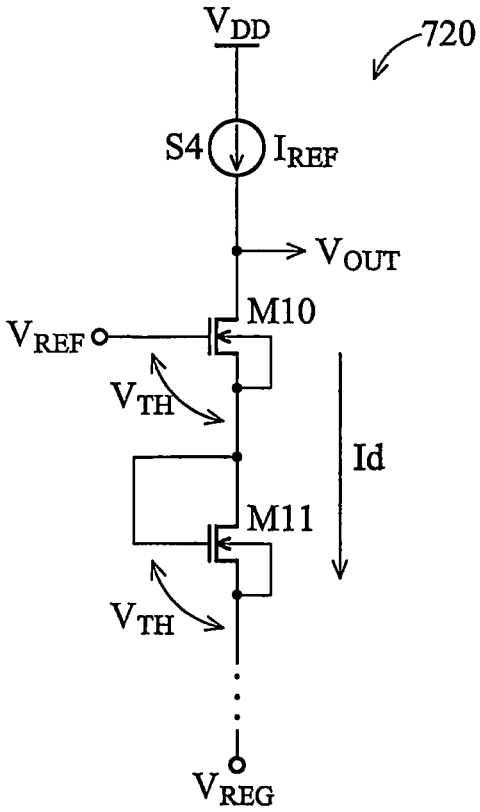
FIG. 7B (PRIOR ART)

Turning now to FIGS. 7A and 7B, illustrated are circuit diagrams of conventional negative boosted voltage regulators 710, 720. Looking individually at the circuits, FIG. 7A illustrates a negative boosted voltage regulator 710 incorporating a single voltage driven active device in the form of transistor device M9. Specifically, the transistor M9 is an NMOS transistor device having the regulated voltage $V_{REG}$ coupled to its drain terminal and a reference voltage $V_{REF}$ coupled to its gate. In addition, a constant reference current ($I_{REF}$) source S3 is provided in the circuit 710 and coupled to the source terminal of NMOS M9, and then to an applied power supply voltage $V_{DD}$. In FIG. 7B, the illustrated negative boosted voltage regulator 720 includes first and second transistor devices M10, M11, where both are NMOS devices. In this circuit 720, the regulated voltage $V_{REG}$ is coupled to the drain of the second NMOS M11, while its gate and source terminals are both coupled to the drain of the first NMOS M10. The reference voltage $V_{REF}$ is coupled to the gate of the first transistor M10, and a constant reference current ($I_{REF}$) source S4 is coupled to its source terminal, and then to an applied voltage $V_{DD}$.

Similar to the conventional positive regulator circuits 310, 320, for either negative voltage regulator 710, 720, the current source S3, S4 draws a constant current IREF through the transistors M9, M10, M11 such that the absolute value of the voltage across the source and gates ($|V_{GS}|$) of each transistor M9, M10, M11 is almost equal to the absolute value of the respective threshold voltage ($|V_{TH}|$) for those transistors M9, M10, M11. However, since the voltage regulators 710, 720 in FIGS. 7*a* and 7B are negative boost, the transfer point for the output voltage $V_{OUT}$ of first circuit 710 is defined by equation (7):

$$V_{REG}=V_{REF}-|V_{TH}|, \tag{7}$$

while the transfer point for the output voltage $V_{OUT}$ of the second circuit 720 is defined by equation (8):

$$V_{REG}=V_{REF}-N*|V_{TH}|. \tag{8}$$

As with the prior equations, $V_{REF}$ is the reference voltage, $V_{TH}$ is the threshold voltage of the transistor devices M9, M10, M11, and N is the number of transistor devices employed in the voltage regulator circuit 720. Also as with conventional PMOS circuits, increased temperatures can degrade the threshold voltages $V_{TH}$ of the NMOS devices, resulting in inaccurate regulation of the regulator voltage $V_{REG}$ by altering the state of the output signal $V_{OUT}$.

Figure 8:
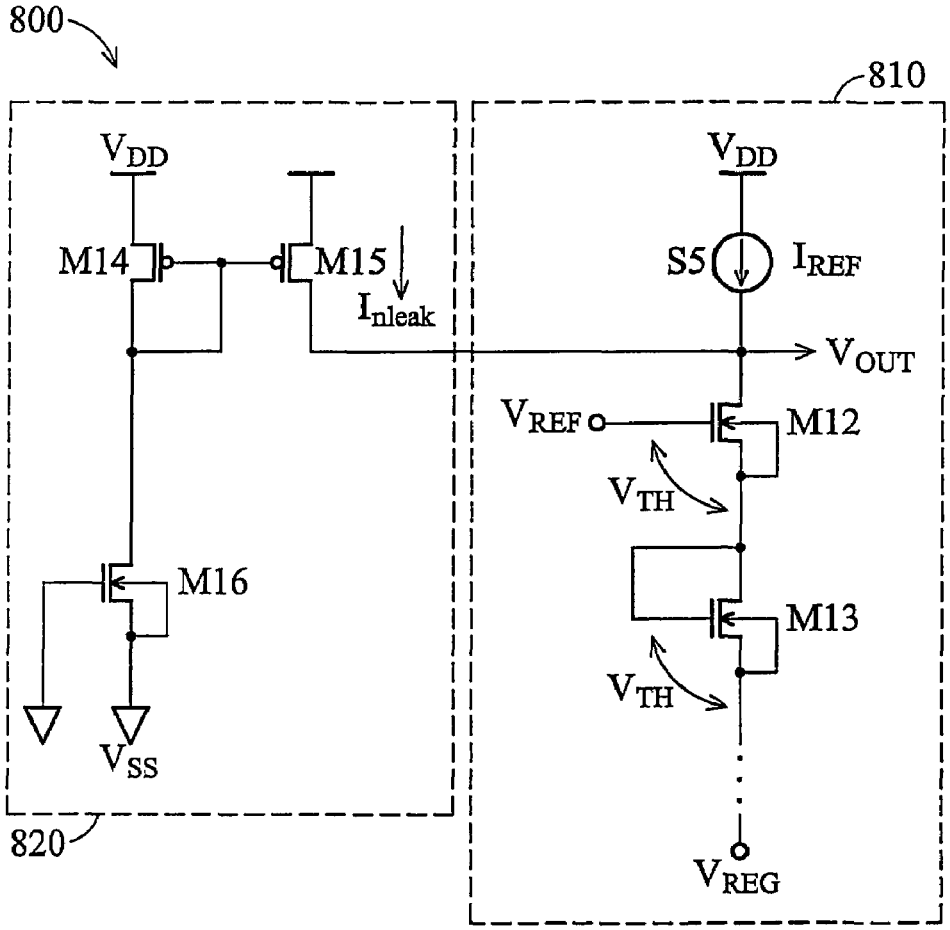
FIG. 8 illustrates a circuit diagram of one embodiment of a negative boosted voltage regulator constructed according to the principles disclosed herein.

Turning finally to FIG. 8, illustrated is a circuit diagram of one embodiment of a negative boosted voltage regulator 800 constructed according to the principles disclosed herein. Similar to the second conventional voltage regulator circuit 720 illustrated in FIG. 7B, the disclosed voltage regulator 800 includes first and second transistor devices M12, M13, which are NMOS devices for use in a negative boost regulator. The regulated voltage $V_{REG}$ input to the voltage regulator 800 is coupled to the drain of NMOS M13, while its gate and source terminals are both coupled to the source of NMOS M12. Also, a reference voltage $V_{REF}$ is coupled to the gate of NMOS M12, while a constant reference current ($I_{REF}$) source S5 is coupled to the source of NMOS M12. The output voltage $V_{OUT}$ of the voltage regulator 800 is found between the source of NMOS M12 and the constant current source S5. These components of the voltage regulator 800 form a base circuit 810.

The voltage regulator 800 of FIG. 8 also includes third, fourth and fifth transistor devices M14, M15, M16, where the third transistor M14 is an NMOS device and the fourth and fifth transistors M15, M16 are PMOS devices. Specifically, the drain and gate of NMOS M14 are coupled to ground ($V_{SS}$), while the source of NMOS M14 is coupled to the drain and gate of PMOS M15. Next, the source of PMOS M15 is coupled to an applied operating voltage $V_{DD}$, while its gate is coupled to the gate of PMOS M16. Finally, the drain of PMOS M16 is coupled to the node where the output voltage $V_{OUT}$ from the voltage regulator 800 is tapped, while the source on the PMOS M16 is coupled to the applied voltage $V_{DD}$.

In order to properly boost voltage at the output $V_{OUT}$ in a negative boost application, and thus to create the positive temperature coefficient discussed above, a leakage current source 820 is created with the third, fourth and fifth transistor devices M14, M15, M16, and is coupled to the base circuit 810. As this current begins to flow through NMOS M14 it reaches PMOS M15, providing a magnification of the current. The magnified current is then mirrored by PMOS M16 as leakage current $I_{n\text{-}leak}$. In this negative boost application, the leakage current source 820 creates the leakage current $I_{n\text{-}leak}$ and provides it to the base circuit 810 of the voltage regulator 800 at the source of NMOS M12, where the output voltage $V_{OUT}$ is tapped, in order to compensate the constant reference current $I_{REF}$ when needed, so as to prevent the output voltage $V_{OUT}$ from changing states (low vs. high) prematurely because of increases in temperature (that cause the threshold voltages $V_{TH}$ of NMOS M12 and M13 to decline). Equation (8) (or equation (7), in one transistor regulator circuits) may thus be derived into equation (9):

$$V_{REG}=V_{REF}-N*|V_{TH}|-\Delta V(I_{n\text{-}leak}), \tag{9}$$

where $V_{REF}$, N, and $V_{TH}$ are as defined above, and $V(I_{n\text{-}leak})$ is the positive temperature coefficient item in the negative boost application that is created by the leakage current $I_{n\text{-}leak}$ provided by the leakage current source 820. The $\Delta V(I_{n\text{-}leak})$ is the cumulative threshold voltage $V_{TH}$ difference across the N transistors based on their drain/source currents $I_{DS}$ when the leakage current $I_{n\text{-}leak}$ is provided. Thus, with a voltage regulator based on the circuit 800 illustrated in FIG. 8, a positive temperature coefficient may also be generated in negative boost applications, while retaining all the benefits described above for positive boost applications.

While various embodiments of voltage regulator circuits, and methods for regulating voltages, according to the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," such claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A voltage regulator for regulating a boost voltage generated by a boost circuit, the voltage regulator comprising:

a regulated voltage input operable to receive a regulated voltage derived from the boost voltage;

a reference voltage input operable to receive a constant reference voltage;

an output node operable to provide a feedback signal to the boost circuit for controlling the generated boost voltage;

at least one transistor coupled to the regulated voltage input, the reference voltage input, and the output node, and operable to produce the feedback signal based on a comparison of the regulated voltage to the reference voltage; and a variable current source coupled to the output node and having one or more performance characteristics, the variable current source operable to generate a variable current at the output node to mitigate the affect of one or more performance characteristics of the at least one transistor based on the comparison and the feedback signal such that the boost circuit generates the boost voltage to be substantially constant.

2. A voltage regulator according to claim 1, wherein the at least one transistor comprises at least one field-effect transistor.

3. A voltage regulator according to claim 2, wherein the regulated voltage input is coupled to a source, the reference voltage input is coupled to a gate, and the output node is coupled to a drain of the at least one field-effect transistor.

4. A voltage regulator according to claim 3, wherein the at least one field-effect transistor comprises at least one metal-oxide-semiconductor field-effect transistor.

5. A voltage regulator according to claim 1, further comprising a reference current source coupled to the output node and configured to draw a constant reference current through the at least one transistor.

6. A voltage regulator according to claim 1, wherein the feedback signal increases when the regulated voltage overcomes a threshold voltage of the at least one transistor.

7. A voltage regulator according to claim 6, wherein the mitigating comprises generating the variable current based on the one or more performance characteristics of the variable current source, the variable current further increasing the feedback signal as the variable current increases.

8. A voltage regulator according to claim 7, wherein the variable current source comprises one or more active devices.

9. A voltage regulator according to claim 8, wherein the one or more active devices comprise one or more field-effect transistors.

10. A voltage regulator according to claim 9, wherein a source of a first of the one or more field-effect transistors is coupled to the output node and configured to generate the variable current at the output node.

11. A voltage regulator according to claim 10, wherein a source and gate of a second of the one or more field-effect transistors is coupled to a gate of the first of the one or more field-effect transistors to form a current mirror, the source and gate of the second field-effect transistor further coupled to a constant voltage supply.

12. A voltage regulator according to claim 11, wherein a drain of a third of the one or more field-effect transistors is coupled to the source and gate of the second field-effect transistor, the gate and source of the third field-effect transistor directly coupled to the constant voltage supply, and the source and gate of the second field-effect transistor coupled to the constant voltage supply via the third field-effect transistor.

13. A voltage regulator according to claim 9, wherein the voltage regulator is a positive boost voltage regulator, the at least one transistor, and the one or more field-effect transistors of the variable current source, comprising PMOS devices.

14. A voltage regulator according to claim 9, wherein the voltage regulator is a negative boost voltage regulator, the at least one transistor, and the one or more field-effect transistors of the variable current source, comprising NMOS devices.

15. A voltage regulator according to claim 1, wherein the boost circuit is a charge pump configured to receive the feedback signal and generate the boost voltage.

16. A voltage regulator according to claim 15, wherein the feedback signal is configured to inhibit the generating of the boost voltage by the boost circuit.

17. A voltage regulator according to claim 1, wherein the one or more performance characteristics of the transistor is a decrease in threshold voltage caused by temperature increase or manufacturing process variation.

18. A voltage regulator according to claim 17, wherein the one or more performance characteristics of the variable current source corresponds to the one or more performance characteristics of the at least one transistor.

19. A method of regulating a boost voltage generated by a boost circuit, the method comprising:

receiving a regulated voltage derived from the boost voltage;

receiving a constant reference voltage;

producing a feedback signal based on a comparison of the regulated voltage to the reference voltage, the producing affected by one or more performance characteristics;

providing the feedback signal to the boost circuit for controlling the generated boost voltage; and generating a variable current associated with the feedback signal to mitigate the affect of the one or more performance characteristics based on the comparison and the feedback signal such that the boost voltage is generated to be substantially constant, the variable current also affected by one or more performance characteristics.

20. A method according to claim 19, further comprising producing the feedback signal with at least one field-effect transistor based on the regulated voltage and the constant reference voltage.

21. A method according to claim 20, wherein the regulated voltage is received at a source, the constant reference voltage is received at a gate, and the feedback signal is produced at a drain of the at least one field-effect transistor.

22. A method according to claim 21, wherein the at least one field-effect transistor comprises at least one metal-oxide-semiconductor field-effect transistor.

23. A method according to claim 19, further comprising drawing a reference current source associated with the feedback signal.

24. A method according to claim 19, further comprising increasing the feedback signal when the regulated voltage overcomes a threshold voltage.

25. A method according to claim 24, wherein the mitigating comprises generating the variable current based on the one or more performance characteristics affecting the variable current, the variable current further increasing the feedback signal as the variable current increases.

26. A method according to claim 25, further comprising generating the variable current using one or more active devices.

27. A method according to claim 26, wherein the one or more active devices comprise one or more field-effect transistors.

28. A method according to claim 27, further comprising generating the variable current with a source of a first of the one or more field-effect transistors coupled to the feedback signal.

29. A method according to claim 28, further comprising mirroring a generated current to generate the variable current by coupling a source and gate of a second of the one or more field-effect transistors to a gate of the first of the one or more field-effect transistors, and further coupling the source and gate of the second field-effect transistor to a constant voltage supply.

30. A method according to claim 29, wherein the mirroring further comprises coupling a drain of a third of the one or more field-effect transistors to the source and gate of the second field-effect transistor, and directly coupling the gate and source of the third field-effect transistor to the constant voltage supply, the source and gate of the second field-effect transistor coupled to the constant voltage supply via the third field-effect transistor.

31. A method according to claim 27, wherein the boost voltage is a positive boost voltage and the at least one transistor, and the one or more field-effect transistors generating the variable current, comprise PMOS devices.

32. A method according to claim 27, wherein the boost voltage is a negative boost voltage and the one or more field-effect transistors comprise NMOS devices.

33. A method according to claim 19, wherein the boost circuit is a charge pump configured to receive the feedback signal and generate the boost voltage.

34. A method according to claim 19, wherein the feedback signal is configured to inhibit the generating of the boost voltage by the boost circuit.

35. A method according to claim 19, wherein the one or more performance characteristics affecting the producing of the feedback signal comprises a decrease in threshold voltage caused by temperature increase or by manufacturing process variation.

36. A method according to claim 35, wherein the one or more performance characteristics affecting the variable current corresponds to the one or more performance characteristics affecting the producing of the feedback signal.

37. A boost circuit, comprising:

a charge pump operable to provide a boost voltage;

an oscillator coupled to the charge pump and configured to regulate operation of the charge pump; and a voltage regulator operable to provide a feedback signal to the oscillator for regulating the oscillator, the voltage regulator comprising:

a regulated voltage input operable to receive a regulated voltage derived from the boost voltage;

a reference voltage input operable to receive a constant reference voltage;

an output node operable to provide the feedback signal;

at least one transistor coupled to the regulated voltage input, the reference voltage input, and the output node, and operable to produce the feedback signal based on a comparison of the regulated voltage to the reference voltage; and a variable current source coupled to the output node and having one or more performance characteristics, the variable current source operable to generate a variable current at the output node to mitigate the affect of one or more performance characteristics of the at least one transistor based on the comparison and the feedback signal such that the charge pump generates the boost voltage to be substantially constant.

38. A method of regulating a boost voltage, the method comprising:

generating a boost voltage using a boost circuit;

controlling boost circuit using a boost generating signal; and regulating the boost generating signal with a feedback signal, the regulating comprising:

receiving a regulated voltage derived from the boost voltage;

receiving a constant reference voltage;

producing the feedback signal based on a comparison of the regulated voltage to the reference voltage, the producing affected by one or more performance characteristics; and generating a variable current associated with the feedback signal to mitigate the affect of the one or more performance characteristics based on the comparison and the feedback signal such that the boost voltage is generated to be substantially constant, the variable current also affected by one or more performance characteristics.

* * * * *